US005080565A

United States Patent [19]

Schultz et al.

[11] Patent Number: 5,080,565

[45] Date of Patent: Jan. 14, 1992

[54] RETAINER FOR PISTON HEAD SUBASSEMBLY AND METHOD OF RETAINING PISTON HEAD SUBASSEMBLY

[75] Inventors: Richard A. Schultz; Todd W. Herrick, both of Tecumseh, Mich.

[73] Assignee: Tecumseh Products Company, Tecumseh, Mich.

[21] Appl. No.: 637,370

[22] Filed: Jan. 4, 1991

[51] Int. Cl.[5] ..... F04B 21/04

[52] U.S. Cl. ..... 417/550; 417/552; 137/516.21; 92/255; 92/59

[58] Field of Search ..... 417/454, 545, 550, 552; 137/516.15, 516.19, 516.21, 516.23, 516.17; 92/255, 220, 59

[56] References Cited

U.S. PATENT DOCUMENTS 4,594,760 6/1986 Dillard ..... 29/156.4

4,834,632 5/1989 Gatecliff et al. ..... 417/534

*Primary Examiner*—Richard A. Bertsch

*Assistant Examiner*—Charles Freay

*Attorney, Agent, or Firm*—Baker & Daniels

[57] ABSTRACT

The present invention is a retainer for a piston and valve subassembly of a scotch yoke compressor and a method of assembling it. The subassembly is comprised of a piston head, a suction valve, a spacer, a stop washer, and a rod held together by a retainer. The suction valve is assembled on the rod, then the rod is inserted into the piston head. Next the retainer is installed on an end of the rod for frictionally engaging the piston and rod, thus axially securing the suction valve and the rest of the piston head subassembly during assembly to the yoke.

22 Claims, 2 Drawing Sheets

RETAINER FOR PISTON HEAD SUBASSEMBLY AND METHOD OF RETAINING PISTON HEAD SUBASSEMBLY

BACKGROUND OF THE INVENTION

The present invention relates to refrigeration compressors. More specifically, the field of the invention is that of retaining piston head subassemblies used in scotch yoke compressors.

An example of a scotch yoke compressor is disclosed in U.S. Pat. No. 4,834,632, assigned to the assignee of the present invention, the disclosure of which is expressly incorporated by reference. The scotch yoke mechanism has a plurality of piston heads radially disposed in cylinders around a crankshaft operably connected to a pair of yokes. The piston head subassembly includes a body, a suction valve, a stop washer, a spacer, and a screw. The piston body includes internal passages for refrigerant fluid and an axial hole. The screw extends through the axial hole and holds and axially positions the retainer, spacer, and suction valve so that the piston head subassembly reciprocates in the cylinder as one unit after the screw is attached to the yoke. The spacer positions the valve on the radially outer surface of the piston head, with the valve opening and closing ports to the internal passages. The stop washer prevents the valve from separating from the piston head. The head of the screw abuts the stop washer, which in turn abuts the spacer, which in turn abuts the piston body. The valve travels on the spacer to open and close in accordance with the movements of the piston.

In manufacturing scotch yoke compressors, the piston head subassembly is often assembled at one location and transported to another location for securing to the drive yoke of the compressor. One problem encountered during the assembly process of scotch yoke compressors is that the piston head subassembly may fall apart or become misaligned. Specifically, the valve may become trapped between the spacer and the piston or between the stop washer and the spacer, thus pinching the valve and rendering it partially or fully inoperative. A piston head subassembly which has fallen apart must be re-assembled before being secured to the yoke, adding time and expense to the compressor's manufacture. If not initially recognized during assembly as being defective, a piston head subassembly which becomes misaligned may appear operative initially, but will not function when the compressor is placed in service.

Therefore, what is needed is a piston head subassembly which does not fall apart or become misaligned before or during assembly to the yoke.

Another need exists for a method of manufacturing a compressor which avoids misalignment of the piston head subassembly.

SUMMARY OF THE INVENTION

The present invention is a piston head subassembly and method of manufacturing it. The subassembly is comprised of a piston head, a suction valve, a spacer, a stop washer, and a threaded rod or screw. The suction valve, spacer, and stop washer are assembled on the screw, then the screw is inserted into the piston head. Next a frictional retainer is placed over an end of the screw for frictionally engaging the piston head to secure the suction valve without misalignment. Finally, the subassembly is secured to a yoke of the compressor by threadedly connecting the screw to the yoke.

The frictional retainer of the present invention has an annular body made of metal, plastic, synthetic fiber, or other suitable material which frictionally engages the outer surface of the screw and optionally the inner surface of a cylindrical cavity in the piston head. The retainer is easily slipped over one end of the screw and guided into the cylindrical cavity of the piston head. During handling and transportation of the subassembly previous to attachment with the compressor, the retainer securely holds the piston head, screw, and suction valve together so that the subassembly will not separate. Further, the retainer prevents the suction valve from misaligning and becoming pinched between the spacer and the piston body, or between the washer and the spacer. After the compressor is installed and running, the frictional retainer is no longer needed to hold the subassembly together, however, the retainer is trapped in the cylindrical cavity which does not affect the piston's operation in any manner.

The piston head subassembly of the present invention advantageously includes a spacer and stop washer at one end of the screw for properly positioning and retaining the suction valve. The spacer fits around the screw and centrally locates the suction valve, with the outer circumference of the spacer guiding the opening and closing movements of the valve. The stop washer receives the screw and extends around the inner circumference of the suction valve to prevent the suction valve from separating from the piston head.

The present invention, in one form, is a method of assembling a piston and yoke for use in a scotch yoke compressor. The first step is assembling a suction valve to an elongate rod to form a suction valve subassembly. Next, the rod of the suction valve subassembly is inserted through an opening in a piston so that an end portion of the rod extends out of the piston opening. After insertion, a retainer is installed on the rod end portion whereby the retainer frictionally engages the rod end portion. The retainer is larger than the piston cavity to thereby prevent the rod from being withdrawn from the piston. Finally, the piston, the retainer, and the suction valve subassembly are secured to a yoke member by fastening the rod end portion to the yoke member. Alternatively, the retainer could be positively locked to the rod.

The present invention, in another form, is a compressor comprising a piston, a drive member such as a yoke, a suction valve, a rod, and a frictional retainer. The piston includes a head and an axial opening which extends through the piston from the piston head to a back side of the piston. The yoke is operably connected to reciprocate the piston. The suction valve is located on the piston head. The rod extends through the suction valve and the axial opening to thereby retain the suction valve on the piston head, and includes an end portion extending out of the piston back side. The retainer frictionally engages the rod end portion and abuts the piston back side. The rod end is connected to the yoke to thereby fixedly secure the piston head with the yoke. The retainer is located about the rod between the piston and the yoke.

One object of the present invention is to provide a piston head subassembly which is easily held together during assembly and does not become misaligned.

Another object of the present invention is to provide a method of manufacturing a compressor which facilitates assembly and avoids misalignment of the piston head subassembly.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplifications are not to be construed as limiting the scope of the invention in any manner.

DESCRIPTION OF THE PREFERRED EMBODIMENT

Figure 1:
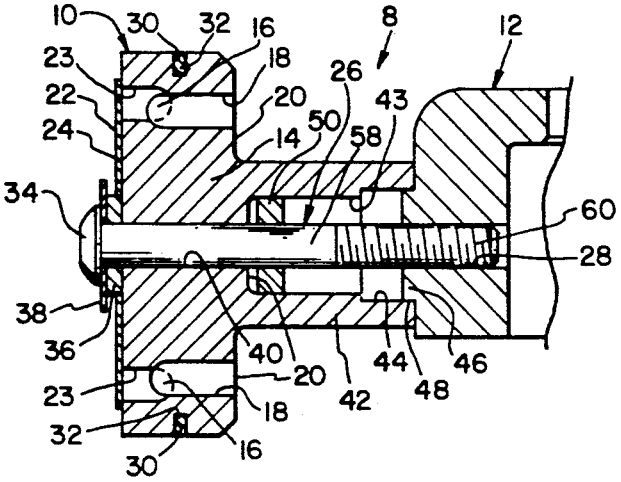
FIG. 1 is a side elevational view, in cross-section, of an assembled piston in accordance with the present invention.

Referring to FIG. 1, piston assembly 8 of the present invention includes piston head subassembly 10 and yoke 12. Piston head 10 has a piston body 14 with inner passages 16 connecting suction ports 18 on back side 20 with intake suction valve 22 covering apertures 23 on radially outer surface 24. Yoke 12 is threadedly secured to piston head 10 by a threaded rod or screw 26, which extends from beyond surface 24 and into threaded bore 28 of yoke 12. Yoke 12 is also coupled to a drive means (not shown) comprising a motor, crankshaft, and slide block, which causes piston head 10 to reciprocate within a cylinder (not shown) of a compressor. Further, piston body 14 includes an annular groove 30 for receiving piston ring 32.

Suction valve 22 is secured over surface 24 by means of head 34 of screw 26, spacer 36, and stop washer 38. Spacer 36 axially aligns suction valve 22 because the outer periphery of spacer 36 guides the inner periphery of suction valve 22. Washer 38 provides a positive stop for movement of suction valve 22. The thickness of spacer 36 is greater than the thickness of suction valve 22 thereby allowing suction valve 22 to move axially along spacer 36. In scotch yoke compressors, the axial movement of suction valve 22 allows refrigerant to pass through passages 16 during the downstroke of the compressor piston cycle.

Screw 26 extends within axial bore 40 of piston head 10 to hold suction valve 22 and engage yoke 12. On back side 20, cylindrical wall 42 extends to form cylindrical cavity 43. At end 44 of cavity 43, protrusion 46 of yoke 12 defines rim 48 which locates end 44 of piston 10, for aligning piston head 10 and yoke 12.

Figure 2:
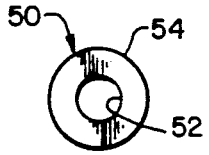
FIG. 2 is a front plan view of the retainer of the present invention.
Figure 3:
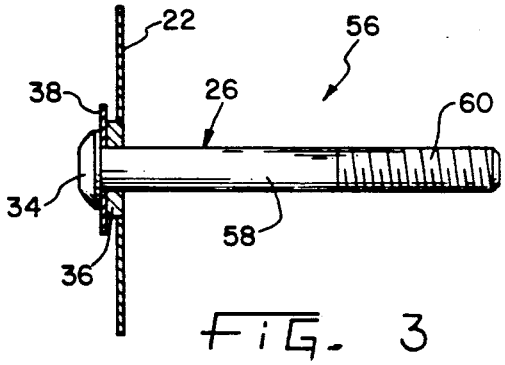
FIGS. 3–6 are side elevational views, in cross-section, of the assembly steps of the piston head subassembly and yoke.

In accordance with the present invention, retainer 50 has a resilient annular body inwardly frictionally engaging screw 26 and preferably outwardly frictionally engaging cylindrical wall 42. Referring to FIG. 2, retainer 50 has an inner axial aperture 52 which defines a cross-sectional area which is slightly less than that of screw 26 to form a frictional fit with screw 26. For example, a screw having an external diameter of 0.187 (nominal) would use a retainer having an internal diameter of 0.175 (nominal) so that the outer peripheral surface area of the screw forms a frictional fit with the inner peripheral surface area of the retainer. Optionally, retainer 50 also has an outer circumferential surface 54 which defines a cross-sectional area which is slightly greater than that of cylindrical cavity 43 to form a frictional fit with piston head 10. For example, a cylindrical cavity having an internal diameter of 0.465 (nominal) would use a retainer having an external diameter of 0.475 (nominal) so that the outer peripheral surface area of the retainer forms a frictional fit with the inner peripheral surface area of cylindrical wall 42 which defines cavity 43.

Retainer 50 may be comprised of a resilient material having a durometer and coefficient of friction sufficient to form the desired frictional engagement, but not so high as to impede attachment over screw 26. Preferably, the desired durometer for the material of retainer 50 is in the range of 65 to 75. The material of retainer 50, in the preferred embodiment, comprises Parker Extruded Neoprene #C873-70 (Per 3BE 715 A14 B14 E014 E034, as described in ASTM D2000/SAE J200).

The steps necessary to build piston assembly 8 are depicted in FIGS. 3–6. First, suction valve subassembly 56 is made by assembling suction valve 22, screw 26, spacer 36, and washer 38 (see FIG. 3). Shank portion 58 of screw 26 receives washer 38, with washer 38 arranged to abut screw head 34. Spacer 36 is next slid over shank 58 and is arranged to abut washer 38. Finally, suction valve 22 is placed about spacer 36 so suction valve 22 can slide over the outer circumferential surface of spacer 36.

Figure 4:
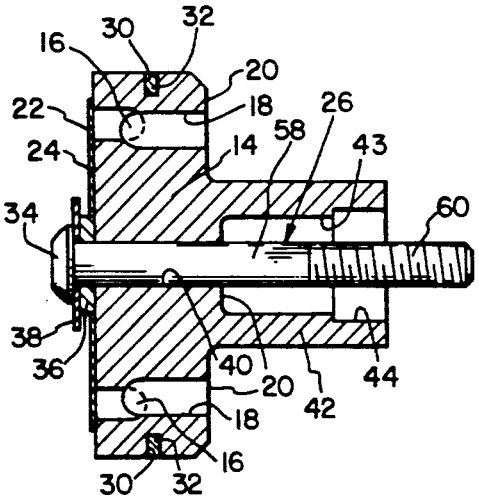
Figure 5:
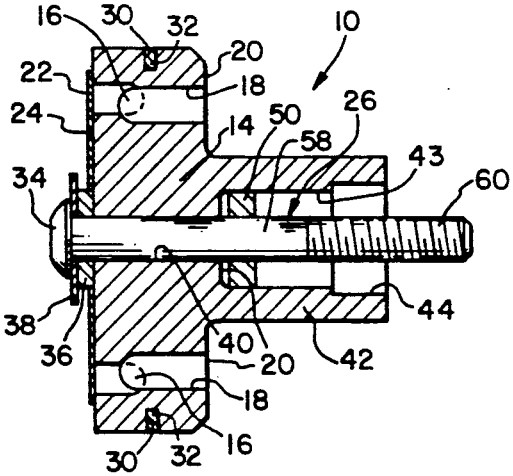

Referring to FIG. 4, the next step in building piston assembly 8 is inserting shank 58 of suction valve subassembly 56 into axial bore 40 of piston body 14. Screw 26 is pushed into bore 40 until spacer 36 contacts surface 24. In the prior art assembly process, the combined suction valve subassembly 56 and piston body 14 would then be attached to yoke 12. However, nothing in the combination of FIG. 4 prevents the axial movement of screw 26 relative to piston body 14. Thus, suction valve 22 could slide off spacer 36 and inadvertently be trapped between spacer 36 and stop washer 38, or between spacer 36 and surface 24 of piston head 10, when screw 26 engages threaded bore 28 of yoke 12. In addition, screw 26 could move completely out of axial bore 40, which may be accompanied by suction valve subassembly 56 falling apart.

In accordance with the present invention, the next step in building piston assembly 8 involves installing retainer 50. Starting with the subassembly arrangement of FIG. 4, aperture 52 of retainer 50 is placed over threaded end 60 of screw 26 then pushed along the outer edges of threaded end 60 until retainer 50 engages the outer surface of shank portion 58. Retainer 50 is pushed along shank portion 58 and into cylindrical cavity 43. At this point, outer circumferential surface 54 engages cylindrical wall 42 if the outer diameter is sufficiently large. Retainer 50 is further urged into cavity 43 until reaching the position shown in FIG. 5. This movement into cavity 43 is resisted by the inner and/or outer circumferences of retainer 50 which frictionally engage screw 26 and wall 42 of piston body 14 which defines cavity 43.

Retainer 50 axially aligns suction valve 22, spacer 36, and stop washer 38, and also holds piston head assembly 10 tightly together by the abutting arrangement of screw head 34, stop washer 38, and spacer 36. The resulting piston head assembly 10 can be handled and transported with relatively little chance of misalignment, separation, or dismantling because screw 26 is fixed in position relative to piston body 14. Suction valve 22 will thereby be axially held on spacer 36 without being pinched by other parts of piston head assembly 10. Although a frictional engagement between retainer 50 and screw 26 is preferred, positive interlocking between a retainer and screw 26 could also be used.

Figure 6:
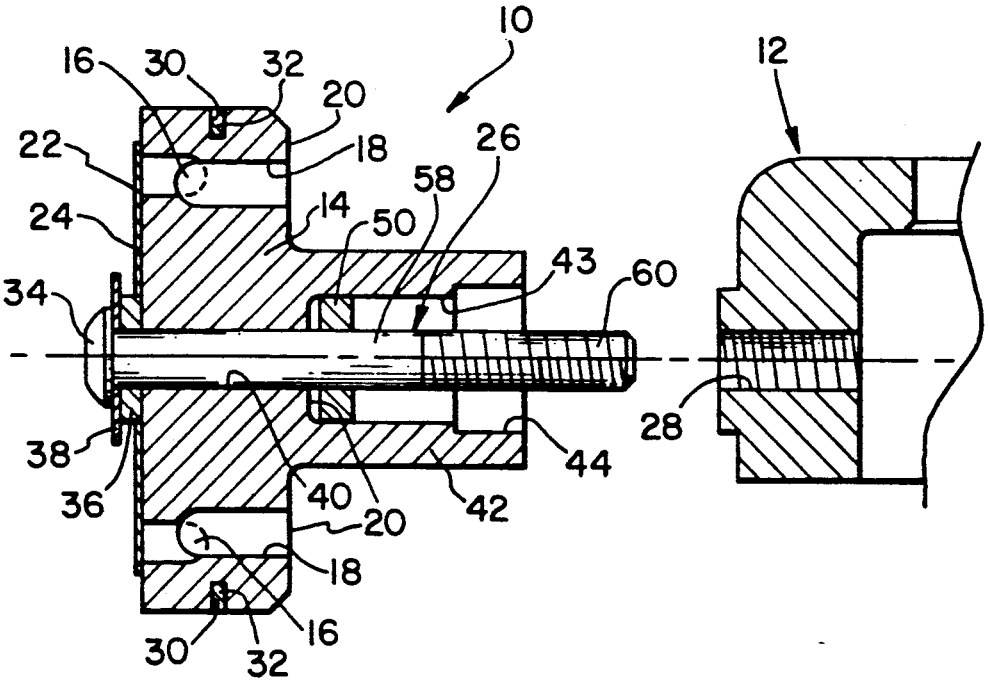

The final step in building piston assembly 8 involves securing piston head 10 to yoke 12. Referring to FIG. 6, piston head 10 and yoke 12 are axially aligned so threaded end 60 can threadedly engage threaded bore 28. Then screw 26 is rotated to secure together piston assembly 8 as shown in FIG. 1. Although retainer 50 will slightly resist the rotation of screw 26 if it is in frictional engagement with wall 42, the aforementioned construction of retainer 50 allows for the rotation of screw 26. Preferably, the threaded connection of piston head 10 and yoke 12 may be further strengthened by applying a band of Loctite, Dri-Loc 201 yellow on threaded end 60.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of assembling a piston head and suction valve subassembly for a compressor, said method comprising:

assembling a suction valve to an elongate rod to form a suction valve subassembly;

inserting said rod of said suction valve subassembly through an opening in a piston so that an end portion of said rod extends out of said piston opening;

then installing a retainer on said rod end portion whereby said retainer frictionally engages said rod end portion and said piston, said retainer being larger than said piston opening to thereby form a piston head and suction valve subassembly wherein said rod is prevented from being withdrawn from said piston.

2. The method of claim 1 wherein said installing step includes axially slipping said retainer over said rod end portion whereby said retainer internally frictionally engages said rod end portion and externally engages said piston to hold said piston and said valve subassembly tightly together in the axial direction.

3. The method of claim 2 wherein said installing step further includes sliding said retainer ring inside a cavity in said piston.

4. The method of claim 3 wherein said retainer has a generally annular shape and engages said elongated rod and said piston cavity during said installing step.

5. The method of claim 1 wherein said retainer is comprised of a material having a durometer in the range of 65 to 75.

6. The method of claim 1 wherein said retainer is comprised of a resilient material.

7. The method of claim 1 wherein said assembling step includes positioning a spacer around said rod and positioning said suction valve concentrically around said spacer.

8. The method of claim 7 wherein said assembling step includes placing a stop washer around said rod before assembling said rod to said spacer and suction valve.

9. A method of assembling a piston and yoke for use in a scotch yoke compressor, said method comprising:

assembling a suction valve to an elongate rod to form a suction valve subassembly;

inserting said rod of said suction valve subassembly through an opening in a piston so that an end portion of said rod extends out of said piston opening and to a cavity in one of said piston and said yoke;

then installing a retainer on said rod end portion whereby said retainer engages said rod end portion, said retainer being larger than said piston opening to thereby prevent said rod from being withdrawn from said piston; and then securing said piston, said retainer, and said suction valve subassembly to said yoke by fastening said rod end portion to said yoke.

10. The method of claim 9 wherein said cavity is in said piston and the installing step includes slipping said retainer over said rod end portion whereby said retainer internally frictionally engages said rod end portion and externally engages said piston cavity.

11. The method of claim 10 wherein said installing step further includes sliding said retainer inside said piston cavity.

12. The method of claim 9 wherein said retainer has a generally annular shape and engages said elongated rod and said piston cavity.

13. The method of claim 9 wherein said retainer is comprised of a material having a durometer in the range of 65 to 75.

14. The method of claim 9 wherein said retainer is comprised of a resilient material.

15. The method of claim 9 wherein said assembling step includes positioning a spacer around said rod and positioning said suction valve around said spacer.

16. The method of claim 15 wherein said assembling step includes placing a stop washer around said rod before assembling said rod to said spacer and suction valve.

17. A compressor comprising:

a piston including a head and an axial opening extending through said piston from said piston head to a back side of said piston;

drive means for reciprocating said piston;

a suction valve on said piston head;

a rod extending through said suction valve and said axial opening to thereby retain said suction valve on said piston head, said rod including an end portion extending out of the back side of said piston; and a retainer means frictionally engaged with said end portion of said rod and engaged with the back side of said piston;

said rod end being connected to said drive means to thereby fixedly secure said piston to said drive means, said retainer means located about said rod between said piston head and said drive means.

18. The compressor of claim 17 wherein said piston includes a cylindrical wall extending from said back side to define a chamber, and said rod is positioned in said chamber axially concentric within said cylindrical wall.

19. The compressor of claim 18 wherein said retainer means includes a resilient annular body having an inner circumference which frictionally engages said rod, said body also having an outer circumference which frictionally engages said cylindrical wall.

20. The compressor of claim 17 wherein said retainer means is comprised of a material having a durometer in the range of 65 to 75.

21. The compressor of claim 17 wherein said retainer means is comprised of a resilient material.

22. The compressor of claim 17 further comprising a valve retainer washer and a spacer located on said piston head and engaged by a head portion of said rod, said spacer axially positioning said suction valve on said piston head.

* * * * *